United States Patent [19]

Shelley

[11] 4,292,891

[45] Oct. 6, 1981

[54] ALUMINUM CAN CRUSHER

[76] Inventor: James D. Shelley, 3574 Buena Vista, Lemon Grove, Calif. 92045

[21] Appl. No.: 162,014

[22] Filed: Jun. 23, 1980

[51] Int. Cl.[3] ..... B30B 1/04

[52] U.S. Cl. ..... 100/193; 100/209; 100/233; 100/293; 100/295; 100/902

[58] Field of Search ..... 100/DIG. 2, 293, 295, 100/233, 137, 193, 209; D15/123

[56] References Cited

U.S. PATENT DOCUMENTS

| | | | |
|---|---|---|---|
| 3,667,386 | 6/1972 | Workman | 100/233 |
| 3,732,804 | 5/1973 | Moller | 100/DIG. 2 |
| 3,766,849 | 10/1973 | Maron | 100/DIG. 2 |
| 3,853,054 | 12/1974 | Jacobsen | 100/DIG. 2 |
| 3,980,015 | 9/1976 | Woodard | 100/233 |
| 3,988,978 | 11/1976 | Flick | 100/DIG. 2 |
| 4,212,242 | 7/1980 | Willis | 100/233 |

FOREIGN PATENT DOCUMENTS

| | | | |
|---|---|---|---|
| 2011302 | 7/1979 | United Kingdom | 100/DIG. 2 |

*Primary Examiner*—Billy J. Wilhite

*Attorney, Agent, or Firm*—Charmasson, Branscomb & Holz

[57] ABSTRACT

A can crusher is provided utilizing a single lever arm pivoted in two places to a pivotal link and a crusher plate respectively and having a unique action wherein upon lifting the lever arm space is provided for a can and a foot extended from the lever arm crushes one end of the can, and upon depressing the arm the can is completely crushed.

5 Claims, 10 Drawing Figures

ALUMINUM CAN CRUSHER

BACKGROUND OF THE INVENTION

The price of scrap aluminum has multiplied several times recently creating an increased interest in recycled aluminum cans. A hard working scavenger can eke out of living of sorts collecting cans, and it provides a nice income for children.

The form in which aluminum recyclers want their cans is crushed, and a currently available can crusher crushes from end-to-end, creating a thick disc that is difficult for the shredding mechines to handle.

A number of other crushers have been developed which crush the cans sideways, but these can be somewhat complicated due to the fact that the most practical way to crush a can is to first buckle one and so that the can crushes nicely flat with the two end disks up.

SUMMARY

The present invention is extremely simple and enables the user to first buckle in one end of the can, and then crush the can flat with both ends up in a single up-down movement of a lever.

This is achieved by the use of a long lever arm having a hand grip at the free end, with the other end being pivoted to a connector like to a base plane. Between the pivotal length and the hand grip is an extending actuator arm which connects to the top of a hinged crusher plate, and a foot extending downward form the pivoted end of the arm crushes one end of the can inward to create a buckle as the arm is lifted, setting the can up for a clean, flat crush as the crusher plate is lowered by pushing down on the lever arm.

DETAILED DESCRIPTION OF THE PREFERRED EMBODIMENT

Figure 1:
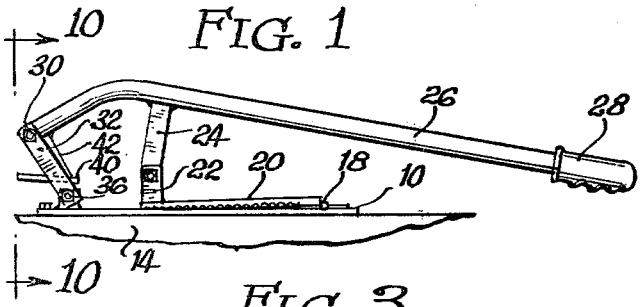
FIG. 1 is a side elevation view of the crusher.
Figure 3:
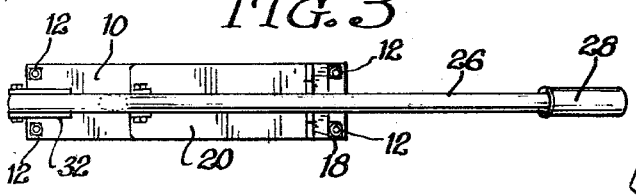
FIG. 3 is a top elevation view of the crusher.
Figure 9:
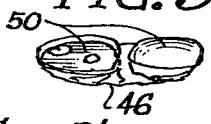
FIG. 9 is a side perspective of a can having been crushed.
Figure 8:
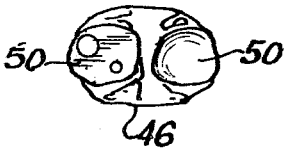
FIG. 8 is a top elevation view of a can after crushing.
Figure 7:
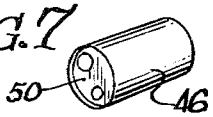
FIG. 7 is a perspective of a can to be crushed.
Figure 5:
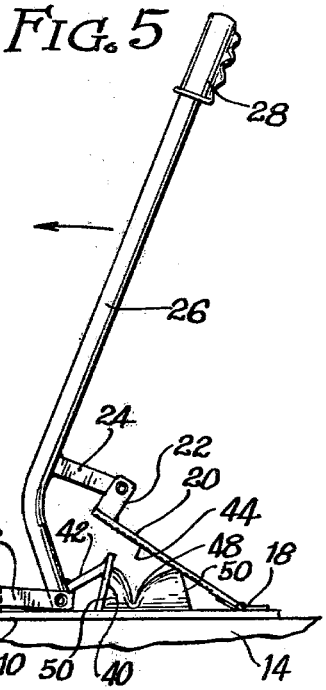
FIG. 5 is a side elevation view showing the lever arm further raised to buckle the can.
Figure 4:
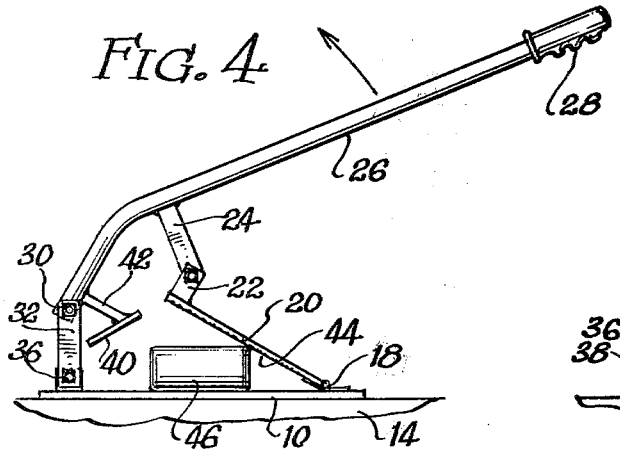
FIG. 4 is a view of the crusher with the lever arm being raised to accept a can.

The invention utilizes a base 10 which is bolted as at 12 in FIG. 3 to either a horizontal or vertical surface, 14 or 16, respectively. To this plate a first hinge 18 mounts a crusher plate 20, the other end of which has a pair of flanges 22 straddling a pivotally connected actuator arm 24 of a lever arm 26. The lever arm has a hand grip 28 mounted at its free end, and at its other end it pivoted at 30 to a pivotal link comprising a pair of side plates 32. These plates straddle and are pivoted at 36 to a stud or rest 38 which serves to seat a foot 40 mounted on a bar 42 extending from the end of the pivot arm 26 when the device is in its resting position as shown in FIG. 1. As best seen in FIGS. 4 and 5, the under surface 44 of the crusher plate may be serrated or otherwise provided with a gripping surface to better grip a can 46 to be crushed. This gripping surface could equally well be applied to the top surface of the base 10.

Figure 6:
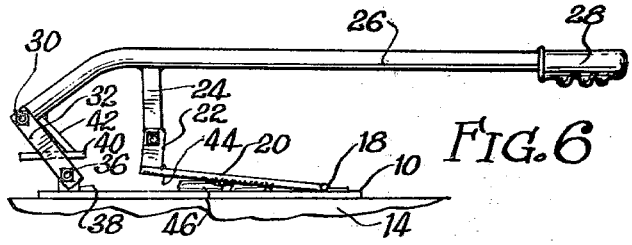
FIG. 6 is a side elevation view showing the arm depressed to crush the can.
Figure 10:
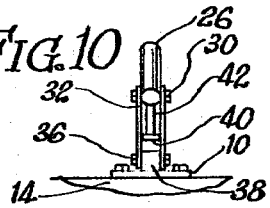
FIG. 10 is a end elevation view looking along lines 10—10 of FIG. 1.

In the use of the device, FIG. 1 shows that in its stored or quiescent state, and in order to use it the handle 26 is raised by the hand grip 28 to the loading position as shown in FIG. 4. A can 46 is inserted beneath the crusher plate 20, and the user then continues to raise the lever arm 26 until the foot 40 is forced against the upper left edge of the can as shown in the drawings, causing the can to buckle at 48, seen in FIG. 5. Once the can is buckled, the two ends 50 are angled inwardly and are disposed in a position that will permit them to be easily crushed by lowering the lever arm 26 as shown in FIG. 6.

It will be noted that the operation and movement of the crusher as described herein is extremely smooth, and the connections of the parts require that they all move in a single path, even though at first the drawings would appear to lead one to believe there would be a good deal of "play" in the mechanism. This is not the case.

Figure 2:
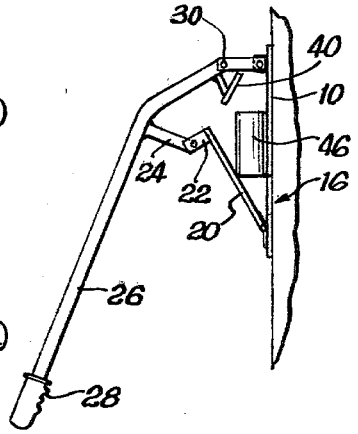
FIG. 2 is a side elevation view of the crusher mounted on a vertical surface.

In a single upward motion on the lever arm or handle 26 the can is buckled, and a single downward motion causes the can to be crushed, so that the same arm, and a single arm, is used for the entire process, distinguishing over certan prior art devices that utilize multiple arms or crusher plates for the crushing action. Another advantage of the device is that it is very easily wall mounted as shown in FIG. 2 as a simple alternative to the basic floor mount.

What is claimed is:

1. A can crusher comprising:

(a) a base;

(b) a crusher plate havng one end pivoted to said base and the other end free of said base;

(c) a lever arm being pivotally connected at a first pivot point along its length to the free end of said crusher plate, said lever arm being pivotally connected at a second pivot point to one end of a pivotal link, the other end of said pivotal link being pivoted to said base;

(e) said lever arm having an extended foot defined on the underside thereof on the side of said first pivot towards said second pivot, whereby, upon raising said lever arm said plate is raised, and upon inserting a can between said base and said plate and further raising said lever said foot buckles one end of said can, and upon subsequently lowering said lever arm said can is crushed against said base by said crusher plate.

2. Structure according to claim 1 wherein said plate is provided with a frictional surface along the portion thereof which engages a can to be crushed.

3. Structure according to claim 1 wherein said pivotal link comprises a pair of side plates stradding a rest positioned on said base to seat said foot when said crusher is in its unused orientation.

4. Structure according to claim 1 wherein said lever arm includes a downwardly directed actuator arm and said first pivot point is defined in the end of said actuator arm.

5. Structure according to claim 4 wherein said actuator arm and pivotal link are substantially the same length.

* * * * *